US011804140B2

(12) United States Patent
Ortlieb et al.

(10) Patent No.: US 11,804,140 B2
(45) Date of Patent: Oct. 31, 2023

(54) TRAJECTORY PLANNING METHOD AND TRAJECTORY PLANNING ALGORITHM FOR AN AERIAL VEHICLE

(71) Applicant: Volocopter GmbH, Bruchsal (DE)

(72) Inventors: Markus Ortlieb, Karlsruhe (DE); Florian-Michael Adolf, Frankfurt am Main (DE)

(73) Assignee: Volocopter GmbH, Bruchsal (DE)

( * ) Notice: Subject to any disclaimer, the term of this patent is extended or adjusted under 35 U.S.C. 154(b) by 27 days.

(21) Appl. No.: 17/190,571

(22) Filed: Mar. 3, 2021

(65) Prior Publication Data

US 2021/0280072 A1 Sep. 9, 2021

(30) Foreign Application Priority Data

Mar. 4, 2020 (DE) ..... 102020105793.8

(51) Int. Cl.
*G08G 5/00* (2006.01)
*G08G 5/04* (2006.01)

(52) U.S. Cl.
CPC ..... *G08G 5/0034* (2013.01); *G08G 5/0086* (2013.01); *G08G 5/0091* (2013.01); *G08G 5/045* (2013.01)

(58) Field of Classification Search
CPC .. G08G 5/0034; G08G 5/0086; G08G 5/0091; G08G 5/045; G08G 5/0073; G01C 21/20; G01C 21/04; G05D 1/106
See application file for complete search history.

(56) References Cited

U.S. PATENT DOCUMENTS

| | | | | |
|---|---|---|---|---|
| 4,862,373 | A | 8/1989 | Meng | |
| 6,317,690 | B1 | 11/2001 | Gia | |
| 7,321,813 | B2 | 1/2008 | Meunier | |
| 7,853,368 | B2 | 12/2010 | Artini | |
| 2006/0235610 | A1 | 10/2006 | Ariyur et al. | |
| 2007/0181750 | A1* | 8/2007 | Astruc | G08G 5/0034 244/220 |
| 2010/0017113 | A1* | 1/2010 | Artini | G05D 1/0646 701/3 |

(Continued)

FOREIGN PATENT DOCUMENTS

| | | |
|---|---|---|
| CN | 102541056 | 7/2012 |
| CN | 106197426 | 12/2016 |

(Continued)

*Primary Examiner* — Shon G Foley
(74) *Attorney, Agent, or Firm* — Volpe Koenig

(57) ABSTRACT

A trajectory planning method for determining a flight trajectory (FB) for an aerial vehicle (1) in a three-dimensional space from a starting point ($VP_1$) to a finishing point ($VP_2$), in which a) a first trajectory planning, confined to a first plane or area in the three-dimensional space, is carried out in order to obtain a first trajectory planning result with a first trajectory profile (BP1); b) a second trajectory planning, confined to a second plane or area (SE), different from the first plane or area in the three-dimensional space, is carried out in order to obtain a second trajectory planning result; and c) the first trajectory planning result and the second trajectory planning result are combined to form an overall trajectory planning result for the flight trajectory (FB).

22 Claims, 5 Drawing Sheets

(56) References Cited

U.S. PATENT DOCUMENTS

| | | | | |
|---|---|---|---|---|
| 2017/0337824 | A1 | 11/2017 | Chen | |
| 2019/0361452 | A1 | 11/2019 | Tahir et al. | |
| 2020/0342770 | A1* | 10/2020 | Shinya | B64C 39/024 |

FOREIGN PATENT DOCUMENTS

| | | |
|---|---|---|
| CN | 109376900 | 2/2019 |
| CN | 106403948 | 3/2019 |
| CN | 110831861 | 2/2020 |
| CN | 106774392 | 5/2020 |
| CN | 109828600 | 7/2020 |
| CN | 108827297 | 9/2021 |
| CN | 108444482 | 10/2021 |
| KR | 102036716 | 10/2019 |
| WO | 2015030790 | 3/2015 |
| WO | 2017173416 | 10/2017 |
| WO | 2018006216 | 1/2018 |
| WO | 2019077682 | 4/2019 |

* cited by examiner

```
while mission planning
    generate flight surface
    compute roadmap
    while no obstacle changes
        if other changes
            update roadmap edge weights
            plan path
    end
end
```

TRAJECTORY PLANNING METHOD AND TRAJECTORY PLANNING ALGORITHM FOR AN AERIAL VEHICLE

INCORPORATION BY REFERENCE

The following documents are incorporated herein by reference as if fully set forth: German Patent Application No. DE 10 2020 105 793.8, filed Mar. 4, 2020.

TECHNICAL FIELD

The invention relates to a trajectory planning method for determining a flight trajectory for an aerial vehicle in a three-dimensional space.

The invention also relates to a trajectory planning algorithm for determining a flight trajectory for an aerial vehicle in a three-dimensional space.

Finally, the invention relates to an aerial vehicle, in particular a vertical take-off and landing multirotor aerial vehicle, which is preferably electrically driven, with a flight controller.

BACKGROUND

US 2006/235610 A1, U.S. Pat. Nos. 4,862,373 A and 6,317,690 B1 disclose trajectory planning methods which comprise a dimensional reduction of the planning problem or provision of already generated search graphs to allow the trajectory planning to be performed more easily and efficiently. This is required in particular whenever a large number of flight trajectories are to be generated (in real time).

The previously known methods already take first steps in this direction, but are not sufficiently proven in practice.

In the prior art, it has also been found to be particularly disadvantageous that making certain that the trajectory planning performed conforms to applicable regulations, which in particular in the area of aviation are an important factor, can only be ensured with difficulty. However, in particular in inhabited areas, such conformity is a decisive factor and is generally achieved by restricting the solution, that is to say an actually calculated flight trajectory, by prescribed constraints that have to be observed. The solution-finding process through to the final solution (the actual flight trajectory or trajectory) can in this case as a rule only be inspected or verified with difficulty. Furthermore, methods of planning in three-dimensional space "consume" a great amount of computing power to arrive at a solution in complex search spaces, which subsequently does not necessarily prove to be in conformity with the rules. The expression "in conformity with the rules" relates to a set of rules defined by the user, to which a solution is intended to conform. Typically, this set of rules includes regulatory, safety and efficiency-driven considerations. It therefore appears to be advisable to restrict the search space, that is to say a parameter space in which a solution for the trajectory planning problem is sought, to the extent that inadmissible states are already excluded within the set of rules before the actual trajectory planning. This approach is also followed in particular by the prior art documents cited further above.

SUMMARY

The invention is based on the object of further developing the known trajectory planning methods in order to arrive at an even more significant reduction of the required computing power or shorter run times (computing times) with the same computing power. Furthermore, the invention is based on the object of ensuring that, in addition to purely increasing the efficiency of the trajectory planning, all of the planning steps allow themselves to be inspected (are verifiable).

The object mentioned further above is achieved by a trajectory planning method according to one or more features disclosed herein, by a trajectory planning algorithm with one or more features as disclosed herein, and by an aerial vehicle with one or more features disclosed herein. Advantageous developments are defined below and in the claims.

A trajectory planning method according to the invention for determining a flight trajectory for an aerial vehicle in a three-dimensional space provides that the following steps are carried out for determining a flight trajectory from a starting point to a finishing point:

a) a first trajectory planning, confined to a first plane or area in the three-dimensional space, in order to obtain a first trajectory planning result with a first trajectory profile; and b) a second trajectory planning, confined to a second plane or area, different from the first plane or area, in the three-dimensional space, in order to obtain a second trajectory planning result; and c) combining the first trajectory planning result and the second trajectory planning result to form an overall trajectory planning result for the flight trajectory.

A controller configured with a trajectory planning algorithm according to the invention for determining a flight trajectory for an aerial vehicle in a three-dimensional space from a starting point to a finishing point comprises:

i) a first trajectory planning module, which is designed to carry out a first trajectory planning, confined to a first plane or area, preferably a vertical plane, in the three-dimensional space, in order to obtain a first trajectory planning result with a first trajectory profile;

ii) a second trajectory planning module, which is designed to carry out a second trajectory planning, confined to a second plane or area, different from the first plane or area, preferably a second plane or area perpendicular to the first plane or area, in particular horizontal, in the three-dimensional space, in order to obtain a second trajectory planning result; and iii) a third trajectory planning module, which is designed to combine the first trajectory planning result and the second trajectory planning result to form an overall trajectory planning result for the flight trajectory.

An aerial vehicle according to the invention, which may be in particular a vertical take-off and landing multirotor aerial vehicle, which is preferably electrically driven, comprises a flight controller, which is arranged entirely or partially on-board the aerial vehicle, which flight controller determines or prescribes a trajectory for the aerial vehicle, the flight controller comprising or performing a trajectory planning algorithm according to the invention.

The trajectory planning method according to the invention or the trajectory planning algorithm according to the invention is accordingly distinguished by a particular modularity, which allows the use of planning methods that are optimized for a respective flight phase and also ensures that, if there are changed preconditions, not all of the planning steps have to be repeated, which contributes to increased efficiency.

In particular, the trajectory planning method may comprise a step-by-step planning method, which in each planning step identifies inadmissible states in advance and eliminates or excludes them from the search space. Such inadmissible states are consequently no longer available to the subsequent planning step. This operation is traceable for third parties in each step. Possible human intervention, to additionally remove undesired states from the search space, is possible at any time. A corresponding development of the trajectory planning method according to the invention correspondingly provides that it comprises a possibility of intervention for a human operator in order to modify specifically a search space that is available for the trajectory planning. A development of the trajectory planning algorithm according to the invention may also provide a corresponding input possibility.

For simplification and to allow quicker solving of the trajectory planning task, the three-dimensional trajectory planning problem is divided into separate planning problems, a first trajectory planning, confined to a first plane or area, being carried out and a second trajectory planning, confined to a second plane or area, different from the first plane or area, being carried out. Advantageously, the first plane or area is a vertical plane and the second plane or area is a horizontal plane or area, so that first vertical planning is carried out and then horizontal planning. It is generally also possible to use any desired areas or planes, which are advantageously perpendicular to one another. The final flight trajectory is obtained from the superposition of the two planning results, in that the first trajectory planning result and the second trajectory planning result are combined to form an overall trajectory planning result for the flight trajectory.

Within the scope of the invention, the second plane or area in particular, but in principle also the first plane or area, does not have to be formed as planar, that is to say flat, in the mathematically strict sense. Rather, it may for its part have a three-dimensional structure. This is discussed in more detail further below. A truly planar second (surface) area is produced for example in the present case by a projection of the second area into the horizontal.

To simplify the nomenclature, unless otherwise expressly indicated, reference is only made hereinafter to a "plane", even when areas and planes may be meant.

Flight phases that place particular requirements on the planning algorithm may be covered separately by dedicated planning algorithms that are specifically designed for the respective flight phase and plane. A corresponding development of the trajectory planning method according to the invention provides that, for planning dedicated flight phases, such as take-off and/or landing, special trajectory plannings are additionally carried out in order to obtain corresponding dedicated trajectory planning results, which dedicated trajectory planning results are added to the overall trajectory planning result in step c).

A corresponding development of the trajectory planning algorithm according to the invention provides that it comprises at least one further trajectory planning module for planning dedicated flight phases, such as take-off and/or landing, in order to obtain corresponding dedicated trajectory planning results, which dedicated trajectory planning results can be added in particular by the third trajectory planning module to the overall trajectory planning result.

In this way, in a corresponding development, the invention does not use a single planning algorithm, but uses the interaction of a number of planning methods in order to achieve an optimum overall result. This also produces in particular a modular framework, which allows the new planning of individual sections of flight trajectories or individual planning stages without a complete replanning of the entire flight trajectory having to be carried out. The approach according to the invention can also be referred to as a cascading trajectory planning module, the cascade-like form of the method ensuring on the basis of design reasons that transitions between two flight phases that have been planned using different methods are always valid, in particular by corresponding constraints of the superposed flight planning algorithms ensuring identical states at transition points between the flight phases.

Another development of the trajectory planning method according to the invention provides that, in step a), at least the following influencing variables are taken into account for the first trajectory planning: a 3D surface model of a flying environment, which 3D surface model comprises coordinates of obstacles within the flying environment; applicable regulations and aviation rules; aerial-vehicle-specific and load-specific parameters. In this way, the trajectory planning can be adapted to various ambient influences. In particular, at least one of the influencing variables may also be determined dynamically or in real time in order to obtain a correspondingly adapted real-time trajectory planning. This comprises in particular and without restriction the wind direction or strength of the wind or a current volume of air traffic.

A corresponding development of the trajectory planning algorithm according to the invention provides that the first trajectory planning module is designed to take into account at least the following influencing variables for the first trajectory planning: a 3D surface model of a flying environment, which 3D surface model comprises coordinates of obstacles within the flying environment; applicable regulations and aviation rules; aerial-vehicle-specific and load-specific parameters.

Another development of the trajectory planning method according to the invention provides that the 3D surface model is extended to include minimum distances to be maintained from the obstacles. In this way, possible flight trajectories or the search space is/are restricted to those trajectories that ensure a corresponding distance from the obstacles.

A corresponding development of the trajectory planning algorithm provides that the first trajectory planning module is designed to extend the 3D surface model to include minimum distances ($d_{z,min}$) to be maintained from the obstacles.

In a preferred development of the trajectory planning method according to the invention, it is provided that, in particular following step a), the 3D surface model is cut along the first trajectory profile in order to obtain a three-dimensional area or surface or a corresponding model with modified obstacles. In this way, the obstacle density can already be reduced significantly, which is accompanied by a corresponding reduction of the search space and a more efficient implementation of the trajectory planning.

In an extremely preferred development of the trajectory planning method according to the invention, it is provided that a graph with edges and nodes is generated on the basis of the three-dimensional surface, which graph maximizes a distance of the edges from the modified obstacles. In this way, said graph can contain all possible or advantageous trajectories from the starting point to the finishing point.

In another development of the trajectory planning method according to the invention, it may be provided that the individual edges of the graph are given a weighting, which in particular takes into account at least one of the following criteria: edge length, height above the surface, wind potential, ground risk or ground noise. These weightings may be subsequently used in order, in yet another development of the trajectory planning method according to the invention, to determine a cost-optimal trajectory while taking into account the weights. Such a trajectory is a trajectory between the starting point and the finishing point that is formed optimally in terms of cost with regard to certain criteria. For example, it may be—without restriction—a trajectory of minimal edge length, that is to say minimal flying distance.

A development of the trajectory planning algorithm according to the invention provides in this connection that the second trajectory planning module is designed to implement and perform corresponding method steps in order to cut the 3D surface model along the first trajectory profile and to generate a graph with edges and nodes on the basis of the generated three-dimensional surface, which graph maximizes a distance of the edges from the modified obstacles, or to provide the individual edges of the graph with a weighting.

Yet another development of the trajectory planning method according to the invention provides that said trajectory is subsequently converted into a flyable trajectory, by an envelope of the aerial vehicle and possibly the payload being taken into account. Such an envelope may take into account certain physical conditions or constraints, for example an acceleration effect in a certain spatial direction that is not to be exceeded when transporting persons in order to increase passenger comfort.

In a corresponding development of the trajectory planning algorithm according to the invention, it may be provided that the third trajectory planning module is designed to convert a trajectory determined by the second trajectory planning module into a flyable trajectory while taking into account an envelope of the aerial vehicle and the payload.

Another, extremely preferred development of the trajectory planning method according to the invention provides that, when planning dedicated flight phases, additional requirements with respect to obstacle distances and overflight altitudes are taken into account and additional safety criteria are followed, in particular for take-off and/or landing. In particular, it can be provided in this way that take-off and/or landing approach are undertaken against a prevailing wind direction, which wind direction is preferably dynamically determined and introduced into the trajectory planning method.

In yet another development of the trajectory planning algorithm according to the invention, it is provided that additional requirements with respect to obstacle distances and overflight altitudes can be taken into account for the further trajectory planning module and additional safety criteria can be followed for take-off and/or landing, in particular take-off and/or landing approach against a prevailing wind direction.

Advantageously, such dedicated flight phases can be planned independently of the trajectory planning in steps a) and b). Therefore, for example when there is a change in the wind direction, it is not absolutely necessary to perform once again the entire trajectory planning, but it may be sufficient just to newly plan said dedicated flight phases and subsequently combine them suitably with the overall trajectory planning result generated in step c). In other words: when there is a change in wind direction, it may be that only the take-off and landing approach have to be newly calculated, while the rest of the trajectory planning retains its validity. In an advantageous development of the trajectory planning method, a change in the wind may however also be incorporated in the edge weighting of the graph, so that when there is a change in the wind conditions a new trajectory is selected as the best trajectory.

It is also possible in a corresponding development of the trajectory planning method according to the invention, for flying a route in two directions, to generate two separate flight trajectories from an existing result of the trajectory planning, which flight trajectories are at a distance from one another in the first plane or area and/or in the second plane or area. Usually, this is a difference in altitude and a distance horizontally. During take-off and landing, the difference in altitude may be taken into account or achieved by additional maneuvers (for example a helix).

A corresponding development of the trajectory planning algorithm according to the invention provides that the third trajectory planning module or the further trajectory planning module is designed to generate, for flying a route in two directions, two separate flight trajectories or trajectories, which are at a distance from one another in the first plane and/or in the second plane.

BRIEF DESCRIPTION OF THE DRAWINGS

Further properties and advantages of the invention become apparent from the following description of exemplary embodiments with reference to the drawing.

DETAILED DESCRIPTION

Figure 1:
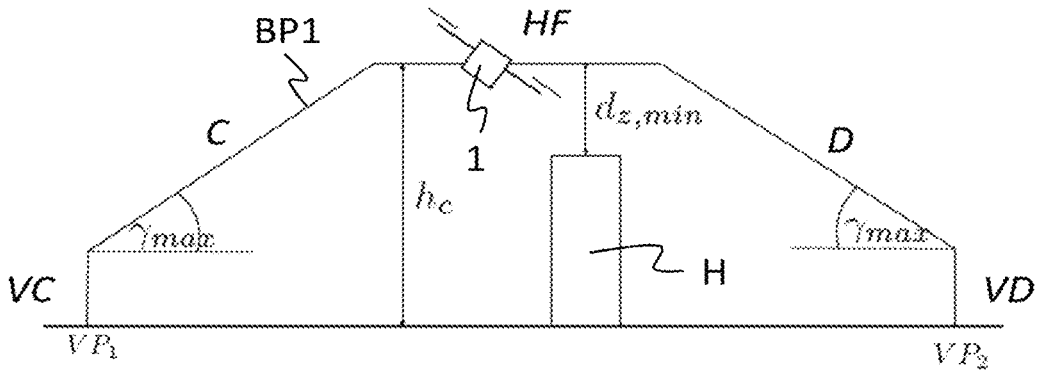
FIG. 1 shows a first, vertical trajectory profile of a flight trajectory for an aerial vehicle.

FIG. 1 schematically shows a first step of a trajectory planning method for determining a flight trajectory for an aerial vehicle in a three-dimensional space. The trajectory planning takes place from a starting point $VP_1$ to a finishing point $VP_2$. The first trajectory planning, illustrated in FIG. 1, is confined to a first plane in a three-dimensional space in order to obtain a first trajectory planning result with a first trajectory profile. This trajectory profile is represented in FIG. 1 by a solid line BP1.

Used as an influencing variable or starting point for the first trajectory planning is a 3D surface model of a flying environment, which comprises obstacles H that have to be flown around or over. Further influencing variables are also often taken into account for the planning, in particular applicable regulations and aviation rules and also aerial-vehicle-specific and load-specific parameters. The former comprise for example minimum distances that have to be maintained from certain types of obstacles. The latter may comprise parameters that indicate for example a possible maximum speed of the aerial vehicle or a maximum permissible acceleration.

The trajectory planning result BP1 for the flight trajectory comprises a number of separate trajectory sections, which in FIG. 1 are denoted by VC (vertical climb), C (climb), HF (horizontal flight), D (descent) and VD (vertical descent). These are therefore a vertically climbing flight, climbing flight, horizontal flight, descending flight and vertically descending flight. Reference sign $h_c$ denotes a (maximum) flying altitude in horizontal flight HF. Reference sign $d_{z,min}$ denotes a minimum vertical distance that the aerial vehicle 1 must maintain with respect to the obstacle H. The angles $\gamma_{max}$ denote maximum permissible ascending and descending angles during the flight phases C, D. Said angles or dimensions may be obtained from said aerial-vehicle-specific and load-specific parameters and/or may be established by applicable regulations and aviation rules. It goes without saying that the invention is not restricted to such influencing variables.

Figure 2:
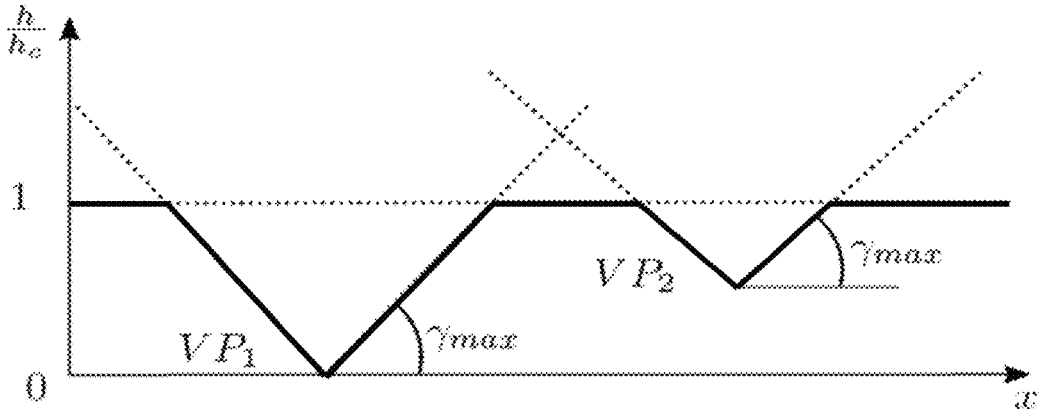
FIG. 2 shows a further vertical flight trajectory profile.

FIG. 2 shows a similar representation as in FIG. 1, but transferred to a starting point $VP_1$ and a finishing point $VP_2$ (also referred to in the present case as "vertiports"), which are arranged in a non-planar environment. In this way, a fixed altitude profile for the flight trajectory is obtained while taking into account the influencing variables specified in FIG. 1, represented in FIG. 2 by way of example in section perpendicularly to the horizontal plane and indicated by a solid line. The x axis denotes a distance or range in the sectional plane; the y axis denotes the flying altitude h, normalized to the (maximum) flying altitude $h_c$ according to FIG. 1.

As already explained further above with reference to FIG. 1, the present surface model is extended to include minimum distances, for example the distance $d_{z,min}$, which distances have to be maintained from certain obstacles or classes of obstacles. Depending on the type of obstacle H, different minimum distances may be required.

Subsequently, a second trajectory planning takes place in a second plane, different from the first plane, in the three-dimensional space in order to obtain a second trajectory planning result. For this purpose, the surface model is cut along the altitude profile (cf. FIG. 1 or FIG. 2), whereby a three-dimensional surface is produced, as represented by way of example in FIG. 3.

This three-dimensional surface already excludes in the vertical dimension all undesired states, that is to say such states that are not on the preplanned profile according to FIG. 1 or FIG. 2, before the further planning.

Figure 3:
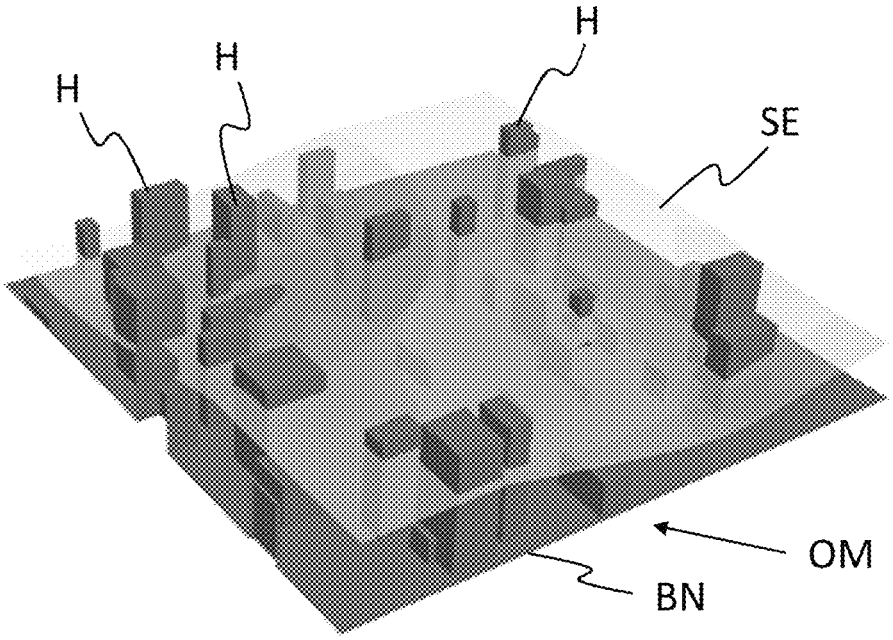
FIG. 3 shows a section of a 3D surface model on the basis of the altitude profile from FIG. 2.

In FIG. 3, reference sign OM denotes the (original) 3D surface model with obstacles H, which for reasons of clarity are not all denoted. Reference sign SE denotes a three-dimensional sectional area corresponding to the altitude profile from FIG. 1 or FIG. 2 and indicates said three-dimensional surface that already excludes all undesired states in the vertical dimension. This surface according to reference sign SE serves as a reduced search space for the subsequent horizontal trajectory planning (second trajectory planning). It is notable in this connection that the obstacle density on this surface SE is reduced significantly in comparison with the obstacle density at ground level, that is to say at reference sign BN in FIG. 3. This is represented more specifically in the following FIG. 4.

Figure 4:
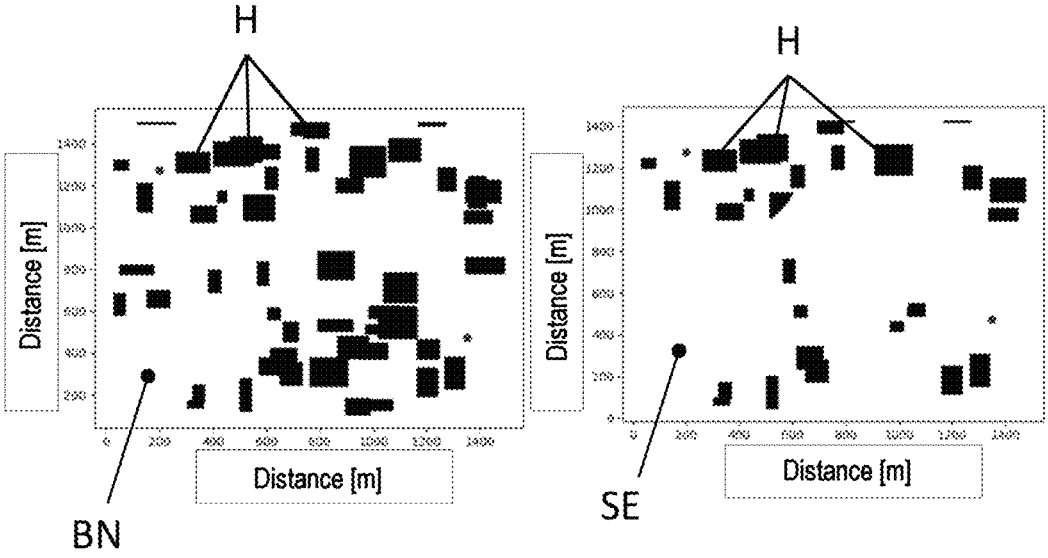
FIG. 4 shows ground obstacles (on the left) and remaining obstacles on the sectional area according to FIG. 3 (on the right)

In FIG. 4, a plan view of the distribution of obstacles H at ground level BN (h=0) of the original 3D surface model OM is shown in the part of the figure on the left. The part of the figure on the right in FIG. 4 shows the same situation, but in the sectional plane SE according to FIG. 3. It is evident at first glance that the number of obstacles H or the obstacle density in the sectional plane SE has decreased in comparison with ground level BN. The simple explanation for this is that all of the obstacles H lying below the flight trajectory determined according to FIG. 1 or FIG. 2, which are therefore flown over in the vertical direction, need not be taken into account any longer in the subsequent horizontal trajectory planning, so that, on the basis of the part of the figure on the right in FIG. 4, the following second trajectory planning can take place in a "more favorable" search space.

Figure 5:
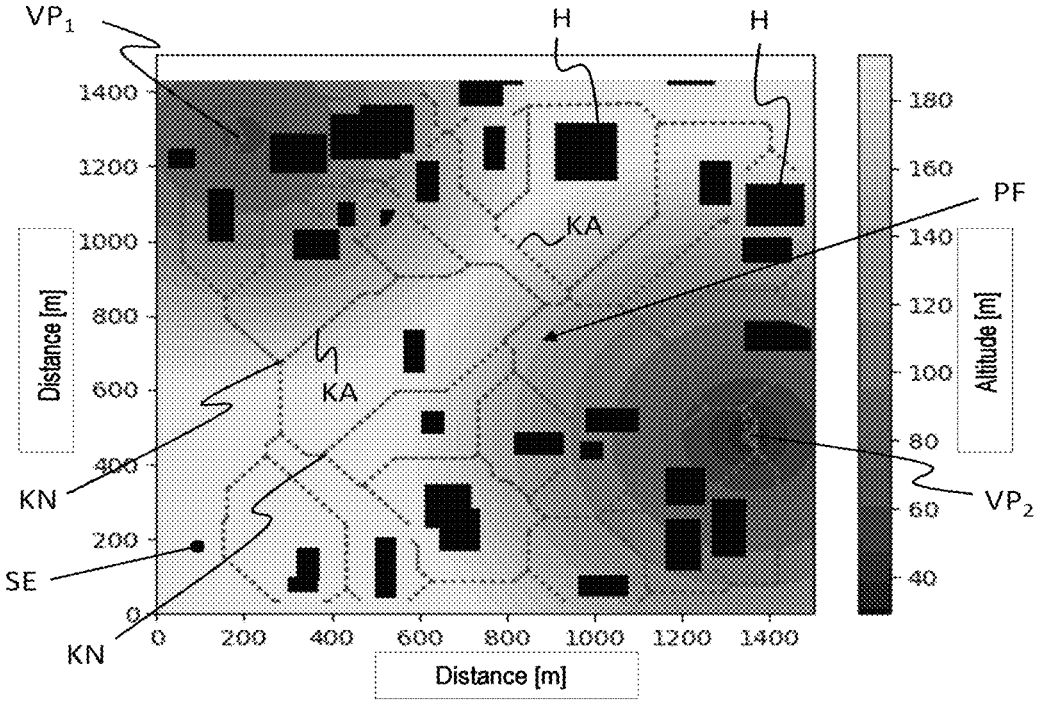
FIG. 5 shows a search graph with remaining edges and nodes in conformity with the rules.

FIG. 5 shows a possible configuration of the second trajectory planning already mentioned several times. On the basis of the surface SE according to FIG. 3 and FIG. 4 or its projection into the horizontal, a graph can be generated, consisting of a number of edges and nodes. The edges KA are represented in FIG. 5 by dotted lines. The nodes KN indicate starting and finishing points as well as branches and kinks of the edges KA. For reasons of clarity, not all of the edges KA or nodes KN are denoted in FIG. 5. Edges KA and nodes KN that are below prescribed minimum distances are not generated at all in the first place for reasons of efficiency, so that the final graph according to FIG. 5 only contains trajectories PF from the starting point $VP_1$ to the finishing point $VP_2$ that meet the respective requirements. FIG. 5 specifically shows such a graph that omits passages between obstacles H with small distances, so that certain edges end in the vicinity of obstacles—such trajectories correspondingly cannot be flown. Each (flyable) trajectory PF connects the starting point $VP_1$ to the finishing point $VP_2$.

In order thus to ascertain in the course of the second trajectory planning the most favorable trajectory PF from the starting point $VP_1$ to the finishing point $VP_2$, a determination of the so-called edge weights may be performed, since each trajectory PF is made up of a number of edges KA that are connected via nodes KN. The determination of the edge weights therefore corresponds to the sum obtained from the "costs" of all the edges KA of a trajectory and can be ascertained on the basis of a large number of criteria. These criteria comprise—without restriction—the edge length (that is to say the flying distance to be covered along an edge KA), the (average) height of an edge KA above the surface SE (flying distances at higher altitudes may be unfavorable because of the greater energy consumption), wind potential, ground risk or ground noise. The two last-mentioned aspects may for example count against flying routes on which there is an increased risk in the area on the ground in the event of a crash or on which areas on the ground that are considered to be particularly "noise-sensitive", for example residential areas, are flown over.

By the use of graph search algorithms known per se, cost-optimal trajectories PF between a starting point $VP_1$ and a finishing point $VP_2$ can be ascertained in the course of the second trajectory planning according to FIG. 5. Such search algorithms per se are not the subject of the present invention. Typically, methods that are known to a person skilled in the art are used for this. A cost-optimal trajectory PF thus identified is subsequently converted into a flyable trajectory, for which purpose in particular the first trajectory planning result (the first trajectory profile) and the second trajectory planning result (the identified trajectory) are combined for the flight trajectory to be determined. Furthermore, an envelope of the aerial vehicle and the payload is also taken into account in the conversion into a flyable trajectory. The envelope indicates certain physical parameters (for example acceleration values) that the actual movement of the aerial vehicle and the payload must satisfy. In this way, account can be taken of the kinematic and dynamic limits of the system (aerial vehicle and payload), which may relate inter alia to flight safety, physical limits of the capabilities of the system (system limits), the service life and/or passenger comfort.

In this way, the first trajectory planning result and the second trajectory planning result are combined to form an overall trajectory planning result for the flight trajectory, from which said flyable trajectory is obtained.

In a corresponding development, it may also be provided that in particular a separate planning of dedicated flight phases, for example take-off and/or landing, subsequently also takes place. This may involve taking into account additional requirements with respect to obstacle distances and overflight altitudes. Furthermore, the observance of additional safety criteria may be prescribed. In take-off and/or landing, this may comprise that take-off and/or landing approach are undertaken against a prevailing wind direction. Such a wind direction may in particular be determined in real time and incorporated in the trajectory planning method. In addition or as an alternative, statistically prevailing wind directions may be taken into account.

Figure 6:
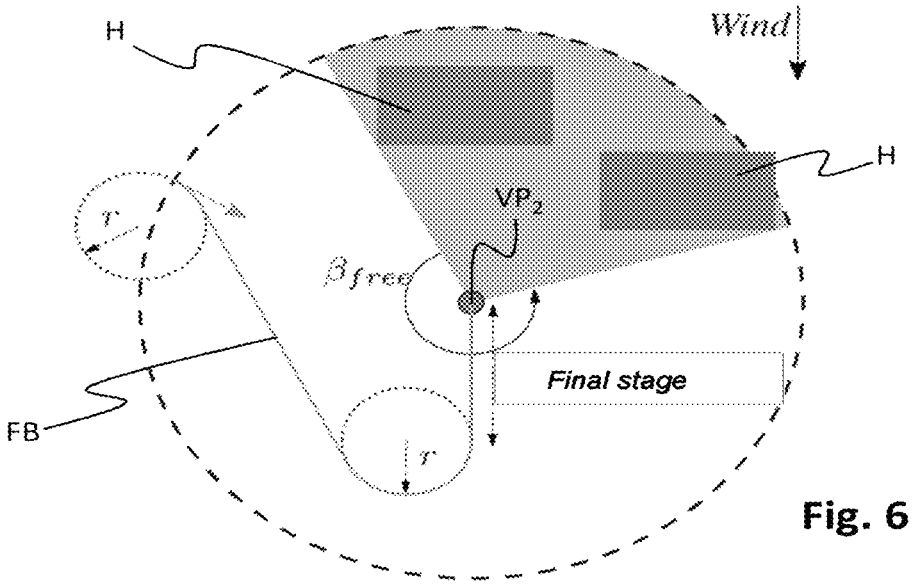
FIG. 6 schematically shows the planning of a dedicated flight phase, in the present case landing approach planning.

Such a situation is schematically represented in FIG. 6. Reference sign FB denotes a planned flight trajectory or flight trajectory to be planned, the final stage of which is to be flown against the depicted wind direction. Reference sign r denotes a minimum maneuvering radius that is permissible or comfortable for passengers, whereby the aerial vehicle is maneuvered from the originally planned trajectory (arrow at the top left in FIG. 6) in such a way that in said final stage it is specifically moving against the wind direction. The depicted angle β denotes a "free approach lane". Theoretically, out in the open, the aerial vehicle could make its approach/fly in from all directions.

In this way, corresponding dedicated trajectory planning results are obtained for certain flight phases, which dedicated trajectory planning results are added to the overall trajectory planning result, to ultimately obtain a complete flight trajectory from the starting point $VP_1$ to the finishing point $VP_2$.

Figures 7, 8:
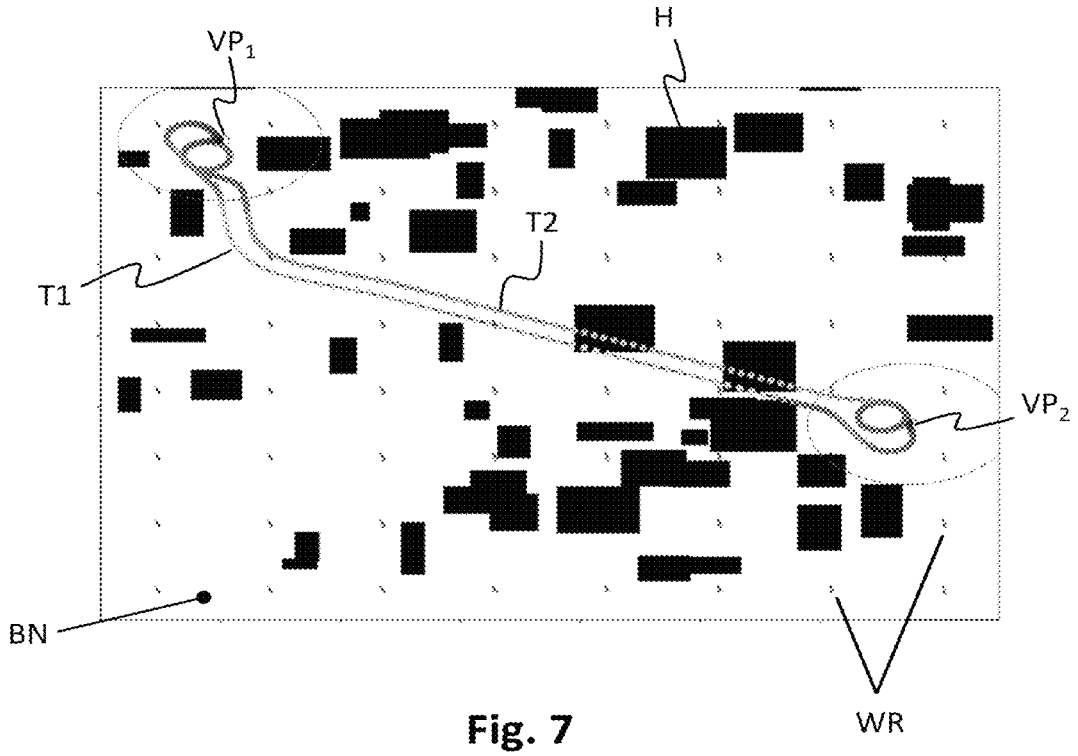
FIG. 7 shows a planning result by way of example on a ground obstacle map.
FIG. 8 shows a detail from a trajectory planning algorithm.

FIG. 7 illustrates an additional trajectory planning algorithm or a corresponding trajectory planning method, which allows a route to be flown in two directions and separates the trajectories for the outward bound flight and the return flight both in the horizontal plane and in the vertical plane from one another. Correspondingly, FIG. 7 shows two trajectories T1 and T2, which do not substantially overlap one another, that is to say apart from the encircled regions with the mentioned, separately planned and dedicated flight phases. Otherwise, the representation in FIG. 7 corresponds to the representation in FIG. 4, on the left. The small arrows WR in FIG. 7 indicate the wind direction.

FIG. 8 comprises in the form of a pseudocode an algorithm such as can be used in principle in the course of the trajectory planning described. This is so because the planning method described offers the great advantage that individual planning steps can be repeated without previous planning steps necessarily likewise having to be repeated. Thus, for example, when there is a change in the wind direction, a new weighting of the graph edges according to FIG. 5 and a calculation of a new route, which is then more favorable in terms of cost, can be carried out without the planning surface (cf. reference sign SE in FIGS. 3 to 5) or the graph itself (FIG. 5) having to be regenerated. The same applies to new plannings of take-off and landing maneuvers according to FIG. 6. The algorithm in FIG. 8 summarizes which planning steps have to be repeated under which preconditions.

The trajectory planning method according to the algorithm in FIG. 8 comprises a while loop, which extends from line L1 to L9. Within this loop, firstly said (flight) surface SE (cf. FIGS. 3 to 5) is generated in line L2. Subsequently, the graph according to FIG. 5 is calculated in line L3.

The inner while loop from L4 to L8 comprises an inquiry as to whether the arrangement of the obstacles has changed. If this is the case, said surface or the graph must be newly calculated. Otherwise, the inquiry as to whether other changes have taken place, for example a change in the wind direction, takes place in line L5. If this is the case, the entire surface or the graph need not be newly calculated, but instead an update of the edge weights of the graph takes place in line L6. Subsequently, the trajectory is (newly) planned in line L7.

In this way, a modular trajectory planning method which can be used flexibly and with calculation resources that can be efficiently used (hardware, software, computing time) is obtained.

Figure 9:
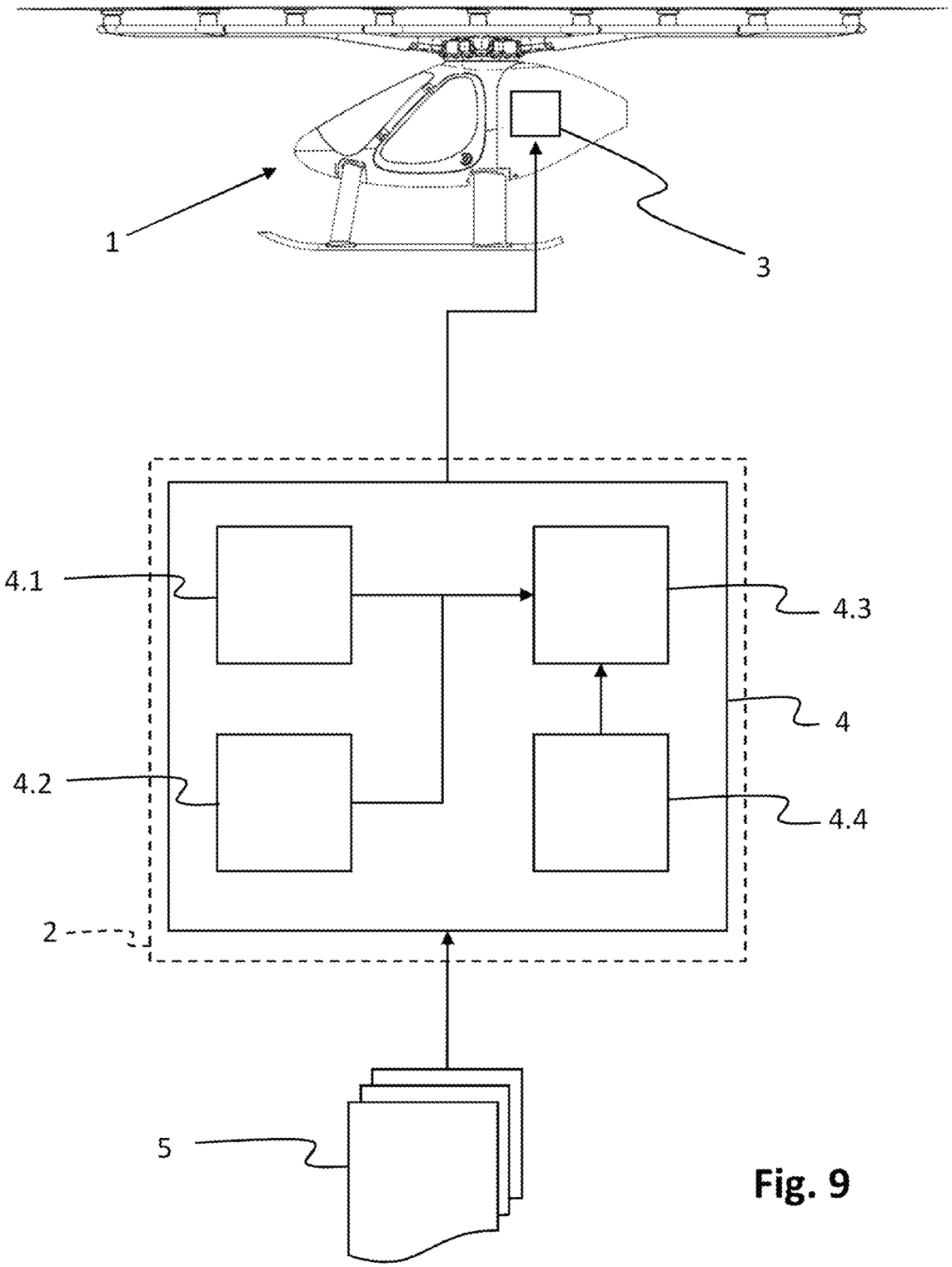
FIG. 9 shows an aerial vehicle with a trajectory planning algorithm.

Finally, in FIG. 9 there is a schematic representation of a trajectory planning algorithm for determining a flight trajectory for an aerial vehicle in a three-dimensional space from a starting point to a finishing point. The aerial vehicle is denoted in FIG. 9, as in FIG. 1, by the reference sign 1. It comprises a flight controller, which is symbolized by a box 2 depicted by dashed lines. The flight controller 2 may take the form of a computer or some other computing unit; it may be arranged entirely or partially on-board the aerial vehicle 1. However, it is within the scope of the invention to provide parts of the flight controller 2 not in the aerial vehicle 1 but on the ground. For example, the basic trajectory planning for the aerial vehicle 1 may already take place on the ground, and only the required trajectory parameters are transferred to the aerial vehicle 1 and stored there in a corresponding unit, which in FIG. 9 is denoted by the reference sign 3. The aerial vehicle 1 subsequently flies along the preplanned trajectory, but this can be altered in real time in accordance with relevant real-time events. It is not intended to discuss this any further at this point.

The flight controller 2 is designed to carry out a trajectory planning algorithm, which has already been mentioned a number of times and is denoted in FIG. 9 by the reference sign 4. The trajectory planning algorithm 4 comprises a number of trajectory planning modules, specifically a first trajectory planning module 4.1, a second trajectory planning module 4.2 and a third trajectory planning module 4.3. At least one further trajectory planning module 4.4 may also be provided.

As already described, the first trajectory planning module 4.1 is designed to carry out a first trajectory planning, confined to a first plane, in which the first plane is preferably a vertical plane. Thus, a first trajectory planning result with a first trajectory profile is obtained. The second trajectory planning module 4.2 is designed to carry out a second trajectory planning, confined to a second plane, which second plane is different from the first plane. Preferably, the second plane is arranged perpendicularly to the first plane. In particular, the second plane may be a horizontal plane. In this way, a second trajectory planning result is obtained. The third trajectory planning module 4.3 is designed to combine the first trajectory planning result and the second trajectory planning result to form an overall trajectory planning result for the flight trajectory.

The at least one further trajectory planning module 4.4 is intended for the planning of dedicated flight phases, such as in particular take-off and/or landing. In this way, corresponding dedicated trajectory planning results are obtained, which dedicated trajectory planning results can, according to the configuration in FIG. 9, be added by the third trajectory planning module 4.3 to form the overall trajectory planning result. This overall trajectory planning result is subsequently used by the trajectory planning algorithm 4 for determining the actual flyable trajectory, which trajectory is—as already mentioned—transmitted to the aerial vehicle 1.

Reference sign 5 in FIG. 9 denotes certain influencing variables in the form of (measurement) data and/or models or specifications that are available to the trajectory planning algorithm 4 in order to be taken into account in the course of the trajectory planning, as already discussed. Without restriction, this is a 3D surface model of the flying environment with coordinates of obstacles within the flying environment, applicable regulations and aviation rules and also aerial-vehicle-specific and load-specific parameters. Preferably, these influencing variables are transmitted to the trajectory planning algorithm 4 in the form of suitably formatted data records. Certain influencing variables, such as for example a wind direction, may be ascertained continuously or in real time (by sensors), so that they are available to the trajectory planning algorithm in real time. Such real-time parameters are not restricted to the wind direction; for example, a current volume of air traffic may also be determined in real time and incorporated in the trajectory planning.

The invention claimed is:

1. A path planning method for determining a flight path (FB) for an aerial vehicle (1) in a three-dimensional space from a starting point ($VP_1$) to a finishing point ($VP_2$), the method comprising:

a) carrying out a first path planning, confined to a first plane or area in the three-dimensional space, in order to obtain a first path planning result with a first path profile (BP1);

b) carrying out a second path planning, confined to a second plane or area (SE), different from the first plane or area, in the three-dimensional space, in order to obtain a second path planning result;

c) combining the first path planning result and the second path planning result to form an overall path planning result for the flight path (FB);

d) for flying an outward bound flight and a return flight for a route, generating two separate trajectories or flight paths (T1, T2) for the outward bound flight and for the return flight, respectively, from said first and second path planning results, which trajectories or flight paths for the outward bound flight and the return flight are at a distance from one another in at least one of the first plane or the second plane (SE); and e) flying, by the aerial vehicle, one of said trajectories (T1, T2) for the outward bound flight or the return flight.

2. The path planning method as claimed in claim 1, wherein the first plane or area and the second plane or area (SE) are oriented perpendicularly to one another.

3. The path planning method as claimed in claim 2, wherein the first plane is a vertical plane and the second plane (SE) is a horizontal plane.

4. The path planning method as claimed in claim 1, further comprising for planning dedicated flight phases, including at least one of take-off or landing, carrying out special path plannings in order to obtain corresponding dedicated path planning results, and adding said dedicated path planning results to the overall path planning result in step c).

5. The path planning method as claimed in claim 1, wherein in step a), at least the following influencing variables are taken into account for the first path planning: a 3D surface model (OM) of a flying environment, said 3D surface model comprises coordinates of obstacles (H) within the flying environment; applicable regulations and aviation rules; aerial-vehicle-specific and load-specific parameters.

6. The path planning method as claimed in claim 5, wherein the 3D surface model (OM) is extended to include minimum distances ($d_{z,min}$) to be maintained from the obstacles (H).

7. The path planning method as claimed in claim 6, further comprising cutting the 3D surface model (OM) along the first path profile (BP1) in order to obtain a three-dimensional surface (SE) with modified obstacles (H).

8. The path planning method as claimed in claim 7, further comprising generating a graph with edges (KA) and nodes (KN) based on the three-dimensional surface (SE), said graph maximizes a distance of the edges (KA) from the modified obstacles (H).

9. The path planning method as claimed in claim 8, further comprising assigning a weighting to the individual edges (KA) of the graph to take into account at least one of the following criteria: edge length, height above the surface, wind potential, ground risk or ground noise.

10. The path planning method as claimed in claim 9, further comprising determining a cost-optimal path (PF) while taking into account the weightings.

11. The path planning method as claimed in claim 10, further comprising converting the path (PF) into a flyable trajectory (T1, T2), taking into account an envelope of the aerial vehicle (1) and the payload.

12. The path planning method as claimed in claim 4, further comprising when planning dedicated flight phases, taking into account additional requirements with respect to obstacle distances and overflight altitudes and following additional safety criteria for the at least one of the take-off or landing approach against a prevailing wind direction (WR).

13. A controller configured with a path planning algorithm (4) for determining a flight path (FB) for an aerial vehicle (1) in a three-dimensional space from a starting point ($VP_1$) to a finishing point ($VP_2$), the controller is configured to:

i) carry out a first path planning, confined to a first plane or area in the three-dimensional space, in order to obtain a first path planning result with a first path profile (BP1);

ii) carry out a second path planning, confined to a second plane or area (SE), different from the first plane or area, in the three-dimensional space, in order to obtain a second path planning result;

iii) combine the first path planning result and the second path planning result to form an overall path planning result for the flight path (FB);

iv) for flying an outward bound flight and a return flight, generate two separate trajectories or flight paths (T1, T2) for the outward bound flight and for the return flight, respectively, from said first and second path planning results, which trajectories or flight paths for the outward bound flight and the return flight are at a distance from one another in at least one of the first plane or the second plane (SE) for flying a route in two directions; and v) cause the aerial vehicle to fly one of said trajectories (T1, T2) for the outward bound flight or the return flight.

14. The controller configured with the path planning algorithm (4) as claimed in claim 13, wherein the controller is configured to take into account at least the following influencing variables for the first path planning: a 3D surface model (OM) of a flying environment, said 3D surface model (OM) comprises coordinates of obstacles (H) within the flying environment; applicable regulations and aviation rules; aerial-vehicle-specific and load-specific parameters.

15. The controller configured with the path planning algorithm (4) as claimed in claim 14, wherein the controller is configured to extend the 3D surface model (OM) to include minimum distances ($d_{z,min}$) to be maintained from the obstacles (H).

16. The controller configured with the path planning algorithm (4) as claimed in claim 15, wherein the controller is configured to cut the 3D surface model (OM) along the first path profile (BP1) in order to obtain a three-dimensional surface (SE) with modified obstacles (H).

17. The controller configured with the path planning algorithm (4) as claimed in claim 16, wherein the controller is configured to convert a path (PF) determined by the controller into a flyable trajectory (T1, T2) while taking into account an envelope of the aerial vehicle (1) and a payload.

18. The controller configured with the path planning algorithm (4) as claimed in claim 17, wherein the controller is configured for planning dedicated flight phases including at least on of take-off or landing, in order to obtain corresponding dedicated path planning results, and said dedicated path planning results are added by the controller to the overall path planning result.

19. The controller configured with the path planning algorithm (4) as claimed in claim 18, wherein the controller is further configured to take into account additional requirements with respect to obstacle distances and overflight altitudes and additional safety criteria are followed for the at least one of the take-off or landing approach against a prevailing wind direction (WR).

20. An aerial vehicle (1) comprising a flight controller (2) embodied as the controller of claim 13, the flight controller (2) is arranged entirely or partially on-board the aerial vehicle (1) and prescribes the flight path for the aerial vehicle (1).

21. A path planning method for determining a flight path (FB) for an aerial vehicle (1) in a three-dimensional space from a starting point ($VP_1$) to a finishing point ($VP_2$), the method comprising:

a) carrying out a first path planning, confined to a first plane or area in the three-dimensional space, in order to obtain a first path planning result with a first path profile (BP1), wherein at least the following influencing variables are taken into account for the first path planning: a 3D surface model (OM) of a flying environment, said 3D surface model comprises coordinates of obstacles (H) within the flying environment; applicable regulations and aviation rules; aerial-vehicle-specific and load-specific parameters, and wherein the 3D surface model (OM) is extended to include minimum distances ($d_{z,min}$) to be maintained from the obstacles (H);

b) carrying out a second path planning, confined to a second plane or area (SE), different from the first plane or area, in the three-dimensional space, in order to obtain a second path planning result;

c) combining the first path planning result and the second path planning result to form an overall path planning result for the flight path (FB);

d) for flying an outward bound flight and a return flight for a route, generating two separate trajectories or flight paths (T1, T2) for the outward bound flight and for the return flight, respectively, from said first and second path planning results, which trajectories or flight paths for the outward bound flight and the return flight are at a distance from one another in at least one of the first plane or the second plane (SE); and e) flying, by the aerial vehicle, the flight path (FB) for the outward bound flight or the return flight.

22. A controller configured with a path planning algorithm (4) for determining a flight path (FB) for an aerial vehicle (1) in a three-dimensional space from a starting point ($VP_1$) to a finishing point ($VP_2$), the controller is configured to:

i) carry out a first path planning, confined to a first plane or area in the three-dimensional space, in order to obtain a first path planning result with a first path profile (BP1), wherein at least the following influencing variables are taken into account for the first path planning: a 3D surface model (OM) of a flying environment, said 3D surface model comprises coordinates of obstacles (H) within the flying environment; applicable regulations and aviation rules; aerial-vehicle-specific and load-specific parameters, and wherein the 3D surface model (OM) is extended to include minimum distances ($d_{z,min}$) to be maintained from the obstacles (H);

ii) carry out a second path planning, confined to a second plane or area (SE), different from the first plane or area, in the three-dimensional space, in order to obtain a second path planning result;

iii) combine the first path planning result and the second path planning result to form an overall path planning result for the flight path (FB);

iv) for flying an outward bound flight and a return flight, generate two separate trajectories or flight paths (T1, T2) for the outward bound flight and for the return flight, respectively, from said first and second path planning results, which trajectories or flight paths for the outward bound flight and the return flight are at a distance from one another in at least one of the first plane or the second plane (SE) for flying a route in two directions; and v) cause the aerial vehicle to fly one of said trajectories (T1, T2) for the outward bound flight or the return flight.

* * * * *